US006481068B1

(12) United States Patent
Takasawa

(10) Patent No.: US 6,481,068 B1
(45) Date of Patent: Nov. 19, 2002

(54) SLIDE FASTENER WITH SEPARABLE BOTTOM STOP ASSEMBLY

(75) Inventor: Shigeyoshi Takasawa, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/672,011

(22) Filed: Sep. 29, 2000

(30) Foreign Application Priority Data

Sep. 30, 1999 (JP) ..... 11-279947

(51) Int. Cl.[7] ..... A44B 19/38
(52) U.S. Cl. ..... 24/433; 24/388; 24/434
(58) Field of Search ..... 24/387–389, 418, 24/432–435

(56) References Cited

U.S. PATENT DOCUMENTS

| | | | | | |
|---|---|---|---|---|---|
| 2,048,646 | A | | 7/1936 | Cuttler | 24/388 |
| 2,728,125 | A | | 12/1955 | Wild | 24/388 |
| 2,892,231 | A | | 6/1959 | Ulrich et al. | 24/433 |
| 3,226,061 | A | * | 12/1965 | Taylor | 24/434 X |
| 4,244,087 | A | * | 1/1981 | Akashi | 24/433 |
| 4,610,057 | A | * | 9/1986 | Akashi | 24/433 |
| 4,976,016 | A | * | 12/1990 | Takabatake | 24/433 |
| 5,333,362 | A | * | 8/1994 | Gillioz | 24/433 |
| 5,388,312 | A | * | 2/1995 | Fudaki | 24/433 X |
| 5,412,849 | A | * | 5/1995 | Fudaki | 24/433 X |
| 5,446,949 | A | * | 9/1995 | Fudaki | 24/433 |
| 5,638,585 | A | * | 6/1997 | Mizuno | 24/433 |
| 5,950,286 | A | * | 9/1999 | Failing et al. | 24/433 |
| 6,112,376 | A | * | 9/2000 | Akashi et al. | 24/433 |
| 6,131,250 | A | * | 10/2000 | Fan | 24/432 |
| 6,195,852 | B1 | * | 3/2001 | Kusayama | 24/434 |

FOREIGN PATENT DOCUMENTS

| | | |
|---|---|---|
| EP | 0919152 | 6/1999 |
| FR | 735942 | 11/1932 |
| JP | 1-14169 | 4/1989 |

* cited by examiner

*Primary Examiner*—Robert J. Sandy
*Assistant Examiner*—Ruth C. Rodriguez
(74) *Attorney, Agent, or Firm*—Finnegan, Henderson, Farabow, Garrett & Dunner, LLP

(57) ABSTRACT

An inclined slope face portion is formed on a top face of a box member. This slope face portion has a downward gradient from a side wall of a box-pin-insertion hole up to a side wall of an insert-pin-insertion hole. The insert pin is inserted into the box member in which the box pin is inserted and fixed in a box-pin-insertion hole thereof. Then, when a rear end portion of a slider is brought into contact with the box member, the slider is inclined relative to the box member. Although conventionally, the insert pin was inserted into the insert-pin-insertion hole of the box member from just above the box member, this invention allows the insert pin to be inserted obliquely from above the box member. Therefore, the insertion operation can be carried out smoothly and easily. Thus, the slider is disposed in an inclined posture relative to a box member of the separable bottom stop assembly so as to achieve a smooth operation for inserting the insert pin.

11 Claims, 14 Drawing Sheets

PRIOP ART

SLIDE FASTENER WITH SEPARABLE BOTTOM STOP ASSEMBLY

BACKGROUND OF THE INVENTION

1. Field of the Invention

The present invention relates to a slide fastener with separable bottom stop assembly applicable for both ordinary type slide fastener and concealed type slide fastener for a fly of clothes such as mainly jacket and coat, and more particularly to a slide fastener with separable bottom stop assembly preferable for a concealed type slide fastener, wherein a slider can be brought into contact with a box member of the separable bottom stop assembly in an inclined state.

2. Description of the Related Art

In a conventional ordinary type slide fastener with a separable bottom stop assembly, which is disclosed in Japanese Utility Model Publication No. 1-14169 and shown in FIG. 17, a top surface of the box member 101 of the separable bottom stop assembly is level and there is no partition in the box member 101. Then, a box pin 102 is just inserted into the box member 101 and fixed therein, while an insert-pin-insertion portion is provided adjacent the fixed box member 101.

In a conventional concealed type slide fastener with a separable bottom stop assembly, which is disclosed in Japanese Patent Laid-Open Publication No. 11-155616 and shown in FIG. 18, a top surface of the box member 201 of the separable bottom stop assembly is level and the box member 201 has concave portions 230 for holding a slider inserted therein. There is provided a partition 206 for partitioning a box-pin-insertion hole 204 for a box pin 202 and an insert-pin-insertion hole 205 for an insert pin 203.

In the ordinary type slide fastener with the separable bottom stop assembly shown in FIG. 17, the top surface of the box member 202 is level and therefore, an operation for inserting the insert pin 103 into the box member 101 through the slider cannot be carried out smoothly and easily because it is inserted from just above. Further, it is not possible to reduce a size of the box member 101.

Further, also in the concealed type slide fastener with the separable bottom stop assembly shown in FIG. 18, the top surface of the box member 201 is level and therefore, the operation for inserting the insert pin 203 into the box member 101 through the slider is very troublesome because it is inserted from just above into the box member 201 which is concealed. Further, because a rear end of the slide is accommodated in a top portion of the box member 201 so as to be positioned, a size of the box member 201 cannot be reduced so much.

SUMMARY OF THE INVENTION

Accordingly, the present invention has been achieved in views of the above described problems, and therefore, an object of a first aspect of the invention is to provide a slide fastener with a separable bottom stop assembly, wherein an insert pin can be inserted into a box member of the separable bottom stop assembly of the slide fastener obliquely from above through a slider disposed obliquely above the box member and which enables much smoother and easier insertion of the insert pin than the conventional ones and which allows a reduction of a size of the box member of the separable bottom stop assembly depending on its embodiment.

An object of a second aspect of the present invention is to provide a separable bottom stop assembly of a slide fastener, wherein by improving the box member of the separable bottom stop assembly, the slider is disposed in an inclined state relative to the box member when it is brought into contact with the separable bottom stop assembly and the insert pin can be inserted into the box member smoothly and easily.

An object of a third aspect of the present invention is to provide a slider of slide fastener with separable bottom stop assembly, wherein by improving the slider, the slider is disposed in an inclined state relative to the box member when it is brought into contact with the separable bottom stop assembly and the insert pin can be inserted into the box member smoothly and easily.

An object of a fourth aspect of the invention is to provide a separable bottom stop assembly which is easily applicable for the concealed type slide fastener with separable bottom stop assembly.

An object of a fifth aspect of the invention is to provide a separable bottom stop assembly which is easily applicable for the ordinary type slide fastener with separable bottom stop assembly.

An object of a sixth aspect of the invention is to provide a box member of a separable bottom stop assembly which allows the insert pin to be inserted very easily into the box member, and in which the box pin can be firmly fixed to the box pin.

An object of a seventh aspect of the invention is to provide a concealed type slide fastener with separable bottom stop assembly in which the box member is prevented from being broken easily.

An object of an eighth and a ninth aspects of the invention is to provide a concealed type slide fastener with separable bottom stop assembly having a function for fixing the box member and the box pin firmly to prevent them from swinging in any direction.

An object of tenth and eleventh aspects of the invention is to provide a separable bottom stop assembly of slide fastener, wherein the box member, box pin and insert pin thereof are molded of thermoplastic resin or a separable bottom stop assembly of slide fastener, wherein the box member, box pin and insert pin are molded of metal.

To achieve the above described object, according to the first aspect of the present invention, there is provided a slide fastener with separable bottom stop assembly, comprised of three members including a box member, a box pin and an insert pin, wherein a partition is provided in a center of a box member for partitioning the box member to form a box-pin-insertion hole and an insert-pin-insertion hole; a box pin is inserted and then fixed in the box-pin-insertion hole; an insert pin is engagable with/disengagable from the insert-pin-insertion hole; and when a slider is brought into contact with the box member for opening and closing operation, the slider is formed so as to make contact with the box member such that it is inclined toward a side of the insert-pin-insertion hole with respect to the box member.

Further, according to the second aspect of the present invention, there is provided a slide fastener with separable bottom stop assembly, wherein an inclined slope face portion is formed on a top face of the box member such that said slope face portion has a downward gradient from a side wall of the box-pin-insertion hole to a side wall of the insert-pin-insertion hole.

Furthermore, according to the third aspect of the present invention, there is provided a slide fastener with separable bottom stop assembly, wherein the slider has an inclined slope face portion at a rear end portion thereof, such that said slope face portion has a rising gradient from a flange on a side thereof that can make contact with a side wall of the box-pin-insertion hole up to a flange on a side thereof that can make contact with a side wall of the insert-pin-insertion hole.

Still further, according to the fourth aspect of the present invention, there is provided a slide fastener with separable bottom stop assembly, wherein guide grooves are provided on both sides of the partition in a front wall of the box member so that stringer tapes can be inserted therein.

Still further, according to the fifth aspect of the present invention, there is provided a slide fastener with separable bottom stop assembly, wherein guide grooves are provided on both side walls located at opposite sides of the box member so that stringer tapes can be inserted therein.

Still further, according to the sixth aspect of the present invention, there is provided a slide fastener with separable bottom stop assembly in which the partition has a guide portion inclined along an entire length of the partition on a side of the insert-pin-insertion hole; a protruded engaging portion is provided on a top end of the partition on a side of the box-pin-insertion hole; a tongue-like engaging piece directed upward is provided on a bottom end of a front face of the box pin, wherein the engaging portion of the partition engages the engaging piece of the box pin when the box pin is inserted into the box-pin-insertion hole.

Still further, according to the seventh aspect of the present invention, there is provided a slide fastener with separable bottom stop assembly in which the box member has a shallow guide groove provided along the partition in the front wall of the insert-pin-insertion hole and a deep guide groove provided along the partition in the front wall of the box-pin-insertion hole.

Still further, according to the eighth aspect of the present invention, there is provided a slide fastener with separable bottom stop assembly in which the box pin and the insert pin are connected to supporting members fixed to the stringer tapes by connecting portions that can be inserted into the guide grooves respectively; the connecting portion for the box pin has a concave portion; the box member has a protruded piece protruding from substantially a center of a side face of the guide groove toward an inside of the guide groove formed in the front wall of the box-pin-insertion hole, wherein the protruded piece is adapted to be engaged with the connecting portion below the concave portion.

Still further, according to the ninth aspect of the present invention, there is provided a slide fastener with separable bottom stop assembly in which the box pin and the insert pin are connected to supporting members fixed to the stringer tapes by connecting portions that can be inserted into the guide grooves respectively; the connecting portion for the box pin has a through hole; the box member has a protruded piece protruding from substantially a center of a side face of the guide groove toward an inside of the guide groove formed in the front wall of the box-pin-insertion hole, wherein the protruded piece is adapted to be inserted through the through hole and engaged with the connecting portion below the through hole.

Still further, according to the tenth aspect of the present invention, there is provided a separable bottom stop assembly of slide fastener with separable bottom stop, wherein the box member, box pin and insert pin are molded of thermoplastic resin such as polyamide, polyacetal, polypropylene and polybutylene and terphthalate by injection molding or extrusion molding.

Still further, according to the eleventh aspect of the present invention, there is provided a separable bottom stop assembly of slide fastener with separable bottom stop assembly, wherein the box member, box pin and insert pin are molded of metal such as aluminum alloy and zinc alloy by die-casting.

DESCRIPTION OF THE EMBODIMENTS

Hereinafter, embodiments of a slide fastener with a separable bottom stop assembly of the present invention will be described with reference to the accompanying drawings.

Figure 1:
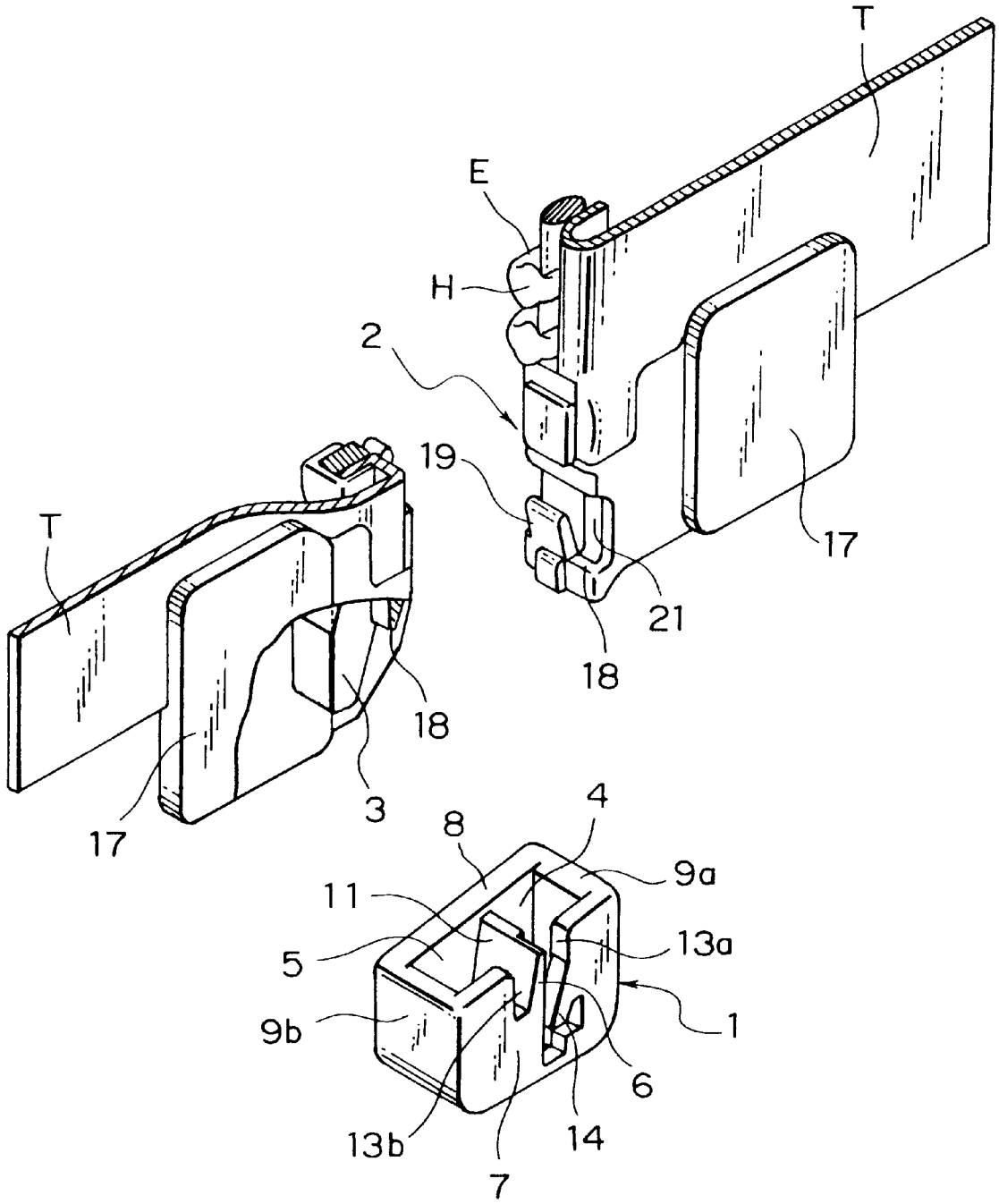
FIG. 1 is an exploded perspective view of a concealed type separable bottom stop assembly according to a first embodiment of the present invention.
Figure 2:
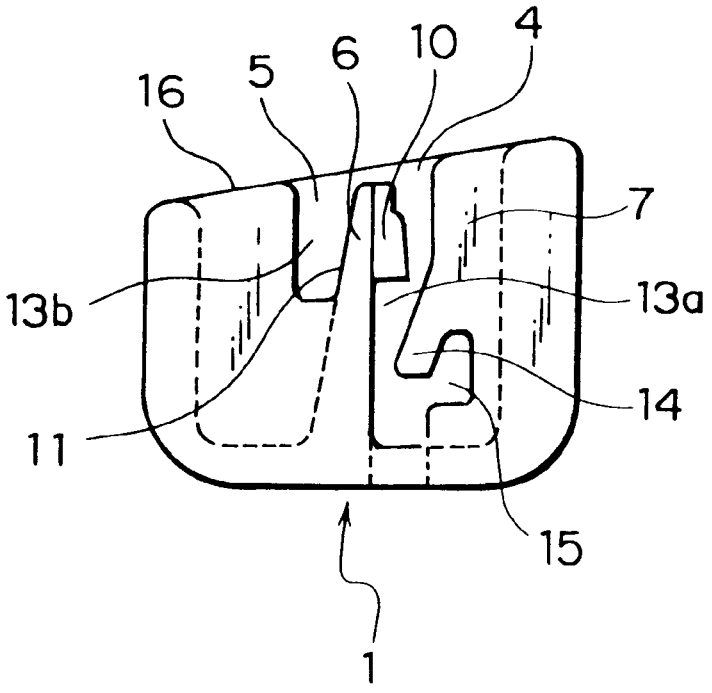
FIG. 2 is a front view of a box member of the same separable bottom stop assembly.
Figure 3:
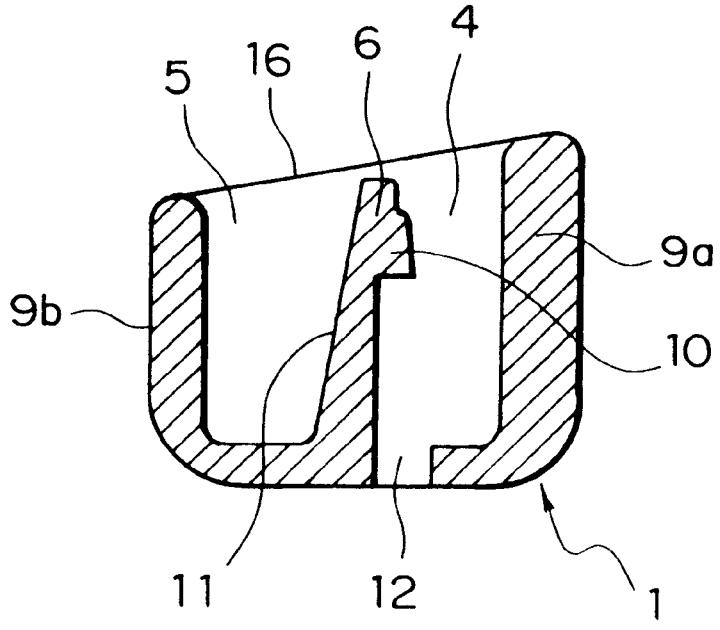
FIG. 3 is a lateral sectional view of the box member of the same separable bottom stop assembly.
Figure 12:
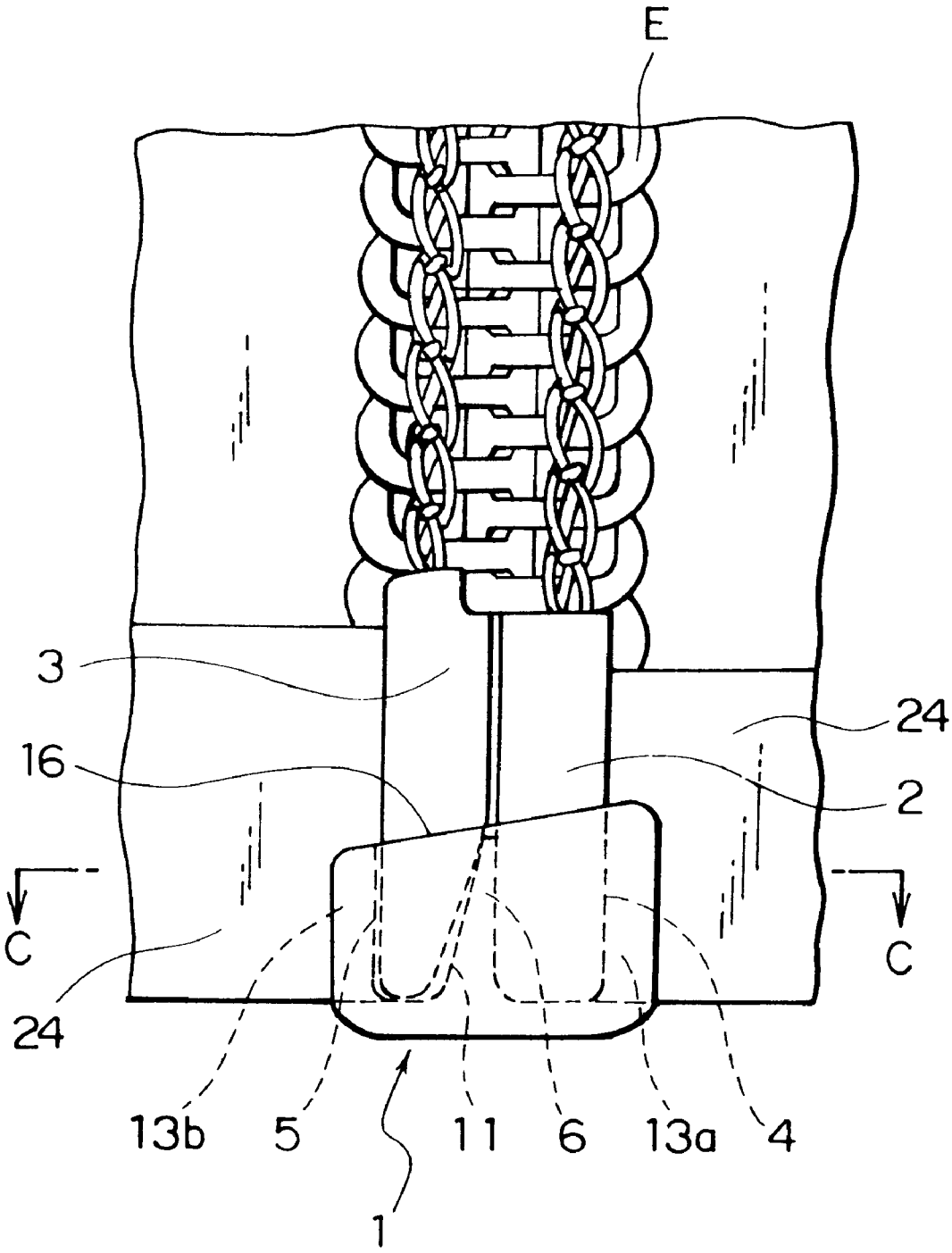
FIG. 12 is a front view of a major portion of a fastener chain having an ordinary type separable bottom stop assembly according to a second embodiment of the present invention.

The slide fastener with the separable bottom stop assembly of the present invention is applicable for both a separable bottom stop assembly of a concealed type slider fastener shown in FIG. 1 and a separable bottom stop assembly of an ordinary type slide fastener shown in FIG. 12. More particularly, it is an optimum separable bottom stop assembly as a separable bottom stop assembly of the concealed type slide fastener. Further, it is characterized by a slider of a slide fastener with a concealed type separable bottom stop assembly shown in FIGS. 14 to 16.

A slide fastener with a concealed type separable bottom stop assembly according to a first embodiment of the present invention will be described with reference to FIG. 1. This separable bottom stop assembly is comprised of three members, i.e. a box member 1, a box pin 2 and an insert pin 3, which are molded by injection molding or extrusion molding means using thermoplastic resin such as polyamide, polyacetal, polypropylene, polybutylene terphthalate. Each of the box pin 2 and insert pin 3 has a substantially rectangular cross sectional shape and mounted on a side edge of a stringer tape T by integral molding such that they are continuously joined to fastener elements E mounted on the side edge of the stringer tape T. The box member 1 contains a box-pin-insertion hole 4 and an insert-pin-insertion hole 5 at left and right sides thereof. The box member 1 is fit to the box pin 2 mounted on one stringer tape T and fixed therein so that a separable bottom stop assembly is completed.

As shown in FIG. 1, coil-like fastener elements E molded of monofilament of thermoplastic synthetic resin fiber are sewed to a surface of one stringer tape T folded back in a U shape in such a manner that coupling head portions H of the fastener elements E are disposed on a folded back side edge of the stringer tape T. Then, the substantially rectangular cross sectional box pin 2 is attached to the fastener elements E by integral molding so as to be continuous to the fastener elements E. The insert pin 3 is also attached to a folded back side edge of the other stringer tape T in the same manner as the box pin 2.

The box member 1, which is a rectangular solid shape, contains a partition 6 vertically extending in a center thereof to form the box-pin-insertion hole 4 and the insert-pin-insertion hole 5 at the right and left of the box member 1. The partition 6 has a portion facing the insert-pin-insertion hole 5 which is inclined through its entire length to form a guide portion 11 for guiding the insert pin 3 to be inserted. A portion facing the box-pin-insertion hole 4 has a vertical face, which is formed with a protruded engaging portion 10 on a top end of the vertical face at a position near a rear wall 8 of the box member 1 so as to be engagable with the box pin 2. Although the insert-pin-insertion hole 5 has a bottom, the box-pin-insertion hole 4 has a hole 12 for insertion of core in a bottom thereof.

Guide grooves 13*a* and 13*b* in which the stringer tapes T can be inserted are provided on both sides of the partition 6 on a front wall 7 of the box member 1. The guide groove 13*b* on a side of the insert-pin-insertion hole 5 is a shallow guide groove 13*b* along the inclined guide portion 11 of the partition 6. On the other hand, a deep guide groove 13*a* is provided on the side of the box-pin-insertion hole 4 reaching the bottom along the vertical face of the partition 6. In the guide groove 13*a*, a crank-like shaped concave portion 15 is provided such that a protruded piece 14 is protruded obliquely downward in the center of a face opposing the partition 6.

A top face of the box member 1 is formed with a slope face portion 16 having a downward gradient from a side wall 9*a* of the box-pin-insertion hole 4 toward a side wall 9*b* of the insert-pin-insertion hole 5. The slope face portion 16 comes into contact with a rear end portion s' of the slider S so that the slider S can be placed obliquely on the slope face portion 165. Specifically, when a rear end portion S' of a slider S is brought into contact with a side wall 9*a* of the box-pin-insertion hole 4, the slider S is capable of being inclined toward a side of the insert-pin-insertion hole 5 of the box member 1. Meanwhile, the partition 6 is extended up to the slope face portion 16.

Figure 5:
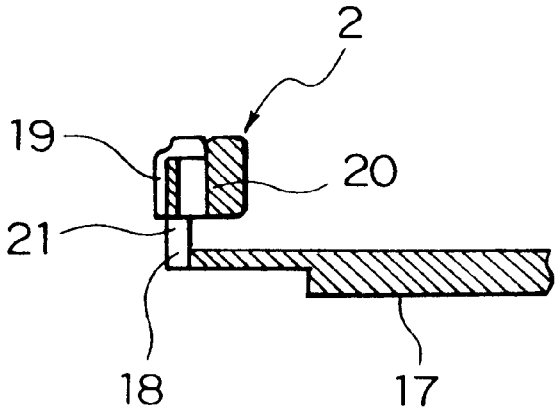
FIG. 5 is a sectional view of the same separable bottom stop assembly taken along the line A—A of FIG. 4.

The box pin 2 is connected to a supporting member 17 in a hook shape such that as shown in FIGS. 1 and 5, the supporting member 17 is continuously joined to the stringer tape T at the folded back side edge thereof or an inner side end thereof. Consequently, a connecting portion 18 is formed between the box pin 2 and the supporting member 17 to form horizontal U shape. This connecting portion 18 is inserted into the deep guide groove 13*a* provided in the front wall 7 of the box member 1. The box pin 2 and the supporting member 17 are. molded integrally of thermoplastic resin and welded to the stringer tape T.

Figure 4:
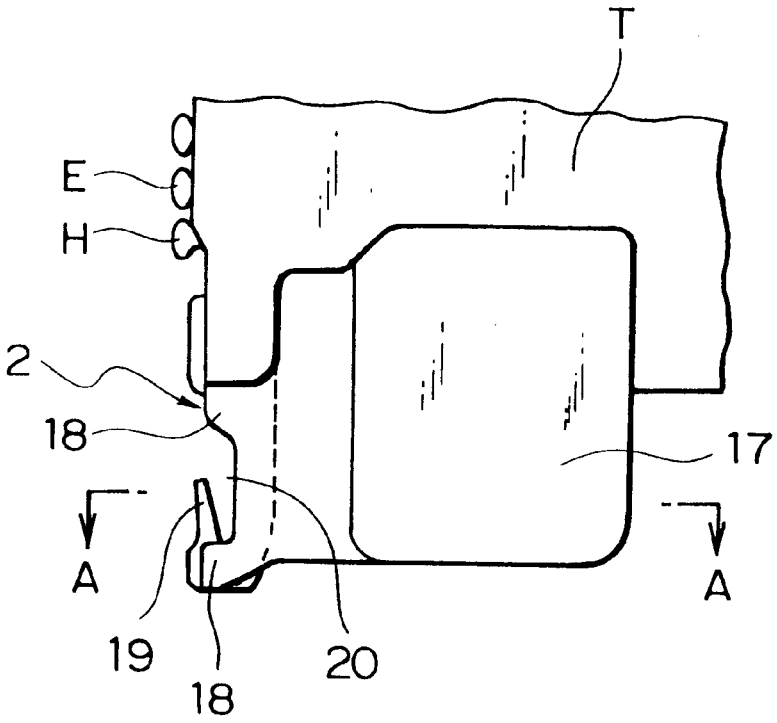
FIG. 4 is a front view of a major portion of a fastener stringer provided with the box pin of the same separable bottom stop assembly.

A tongue-like engaging piece 19 protruded obliquely upward is provided at a bottom end of a front face of the box pin 2 so as to be engagable with the engaging portion 10 provided on the partition 6 of the box member 1. Then, as shown in FIGS. 1 and 4, a concave portion 20 is formed through the box pin 2 and the connecting portion 18 above a base portion of this engaging piece 19, and as shown in FIGS. 1 and 5, a through hole 21 is provided between the box pin 2 and the supporting member 17 in the concave portion 20 at the connecting portion 18 so that the protruding piece 14 provided on the box member 1 can be inserted through this through hole 21. As for the insert pin 3, coil-like fastener elements E formed of monofilament of thermoplastic synthetic resin fiber is sewed to a surface of a side edge folded back in a U shape of the stringer tape T in the same manner as the box pin 2. A substantially rectangular cross sectional insert pin 3 is mounted so as to be continuous to the fastener elements E such that the coupling head portions H of the fastener elements E are disposed on the folded back side edge of the stringer tape T.

Figure 7:
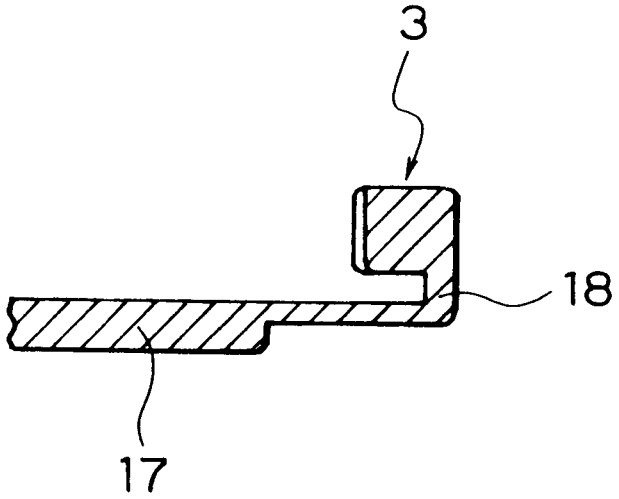
FIG. 7 is a sectional view of the same separable bottom stop assembly taken along the line B—B OF FIG. 6.

The insert pin 3 is connected to a supporting member 17 in a hook shape such that it is joined to the folded back side edge of the stringer tape T as shown in FIGS. 1 and 7. Consequently, a connecting portion 18 is formed between the insert pin 3 and the supporting member 17 so as to form a horizontal U shape. A tip of this connecting portion 18 is cut to be short so that the connecting portion 18 can be inserted into the shallow guide groove 13*b* provided in the front wall 7 of the box member 1. The insert pin 3 is also molded integrally with the supporting member 17 using thermoplastic resin and welded to the stringer tape T.

Figure 6:
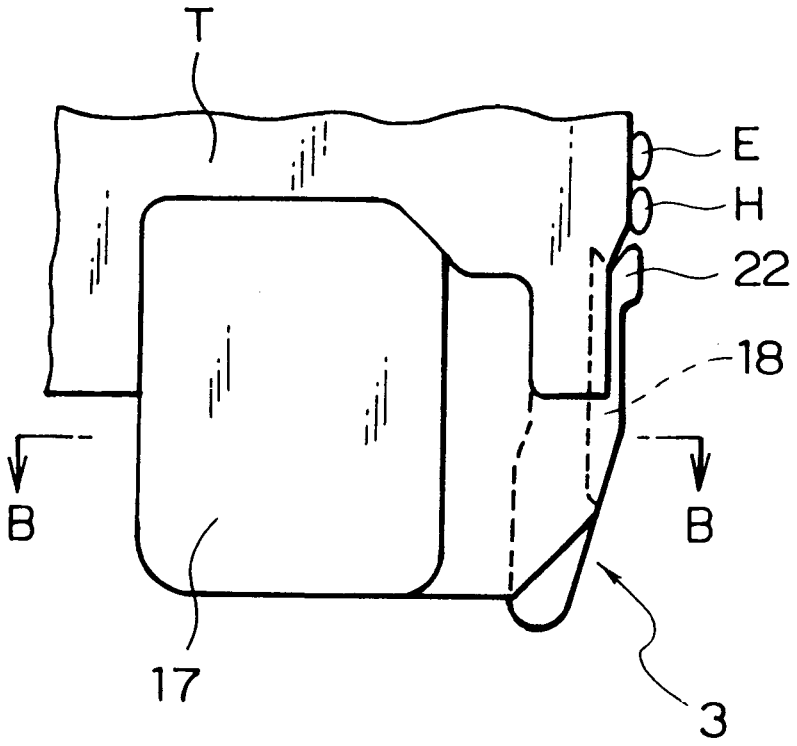
FIG. 6 is a front view of a major portion of the fastener stringer having an insert pin of the same separable bottom stop assembly.

A tip end of the insert pin 3 is formed in a tapered shape providing an inclined face substantially matching with a shape of the guide portion 11 formed on the partition 6 of the box member 1 as shown in FIG. 6. A head portion 22 for coupling the fastener elements E is formed on a top end of the front face of the insert pin 3. The supporting member 17 is formed in an inclined shape from an end of the connecting portion 18, so that the insert pin 3 appears to be protruded, thereby making it easy to insert the insert pin 3 into the box member 1.

For assembling the box member 1 with the box pin 2, the box pin 2 is firstly inserted into the box-pin-insertion hole 4 of the box member 1 by pressure so that the connecting portion 18 is inserted into the deep guide groove 13*a*.

Figure 8:
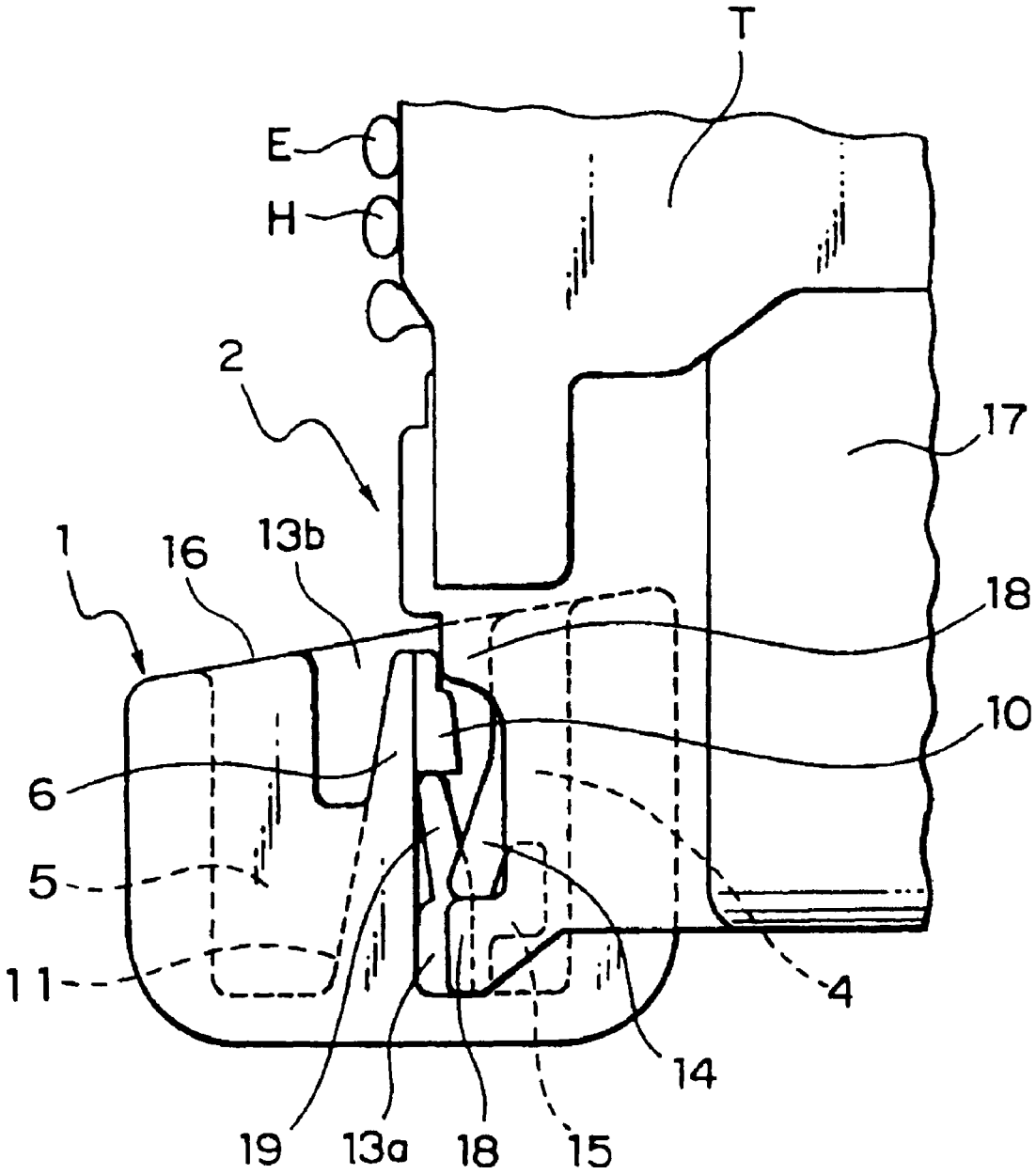
FIG. 8 is a front view of a state in which the box member and the box pin are assembled in the separable bottom stop assembly.

Consequently, as shown in FIG. 8, the engaging piece 19 of the box pin 2 is engaged with the engaging portion 10 of the box member 1 so as to prevent the box member 1 from swinging upward. At the same time, the protruding piece 14 of the box member 1 is inserted into the through hole 21 provided in the connecting portion 18 so that a tip of the protruding piece 14 comes to be engaged with a portion of the connecting portion 18 below the through hole 21 so as to prevent the box member 1 from swinging downward and to the right and left. Therefore, the box pin 2 is fixed firmly in the box member 1 and prevented from swinging vertically and to the right and left in the box member 1 and the box member 1 is mounted to the other stringer tape T.

Figure 9:
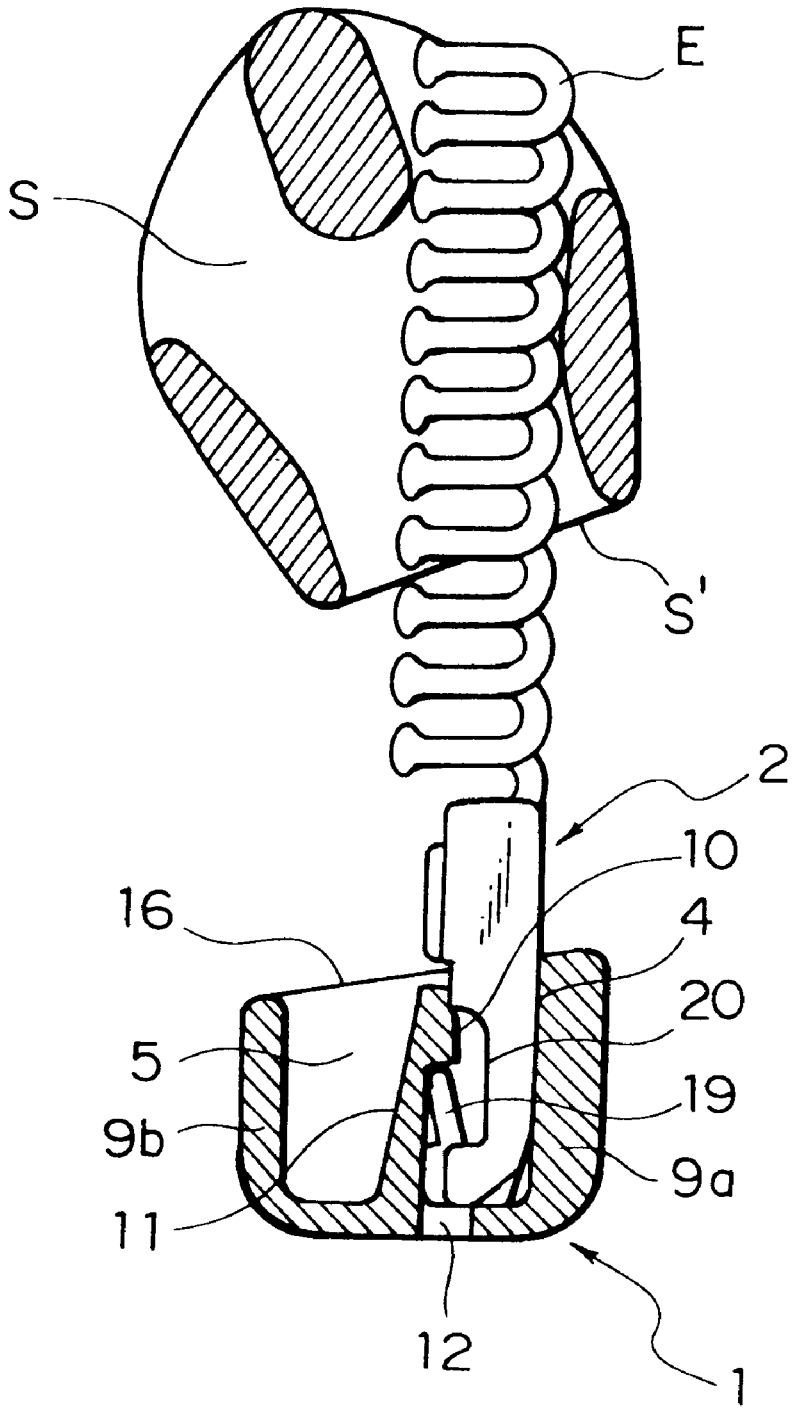
FIG. 9 is an operational view showing an operation of the same separable bottom stop assembly and a state in which a slider is inserted through the fastener stringer.
Figure 10:
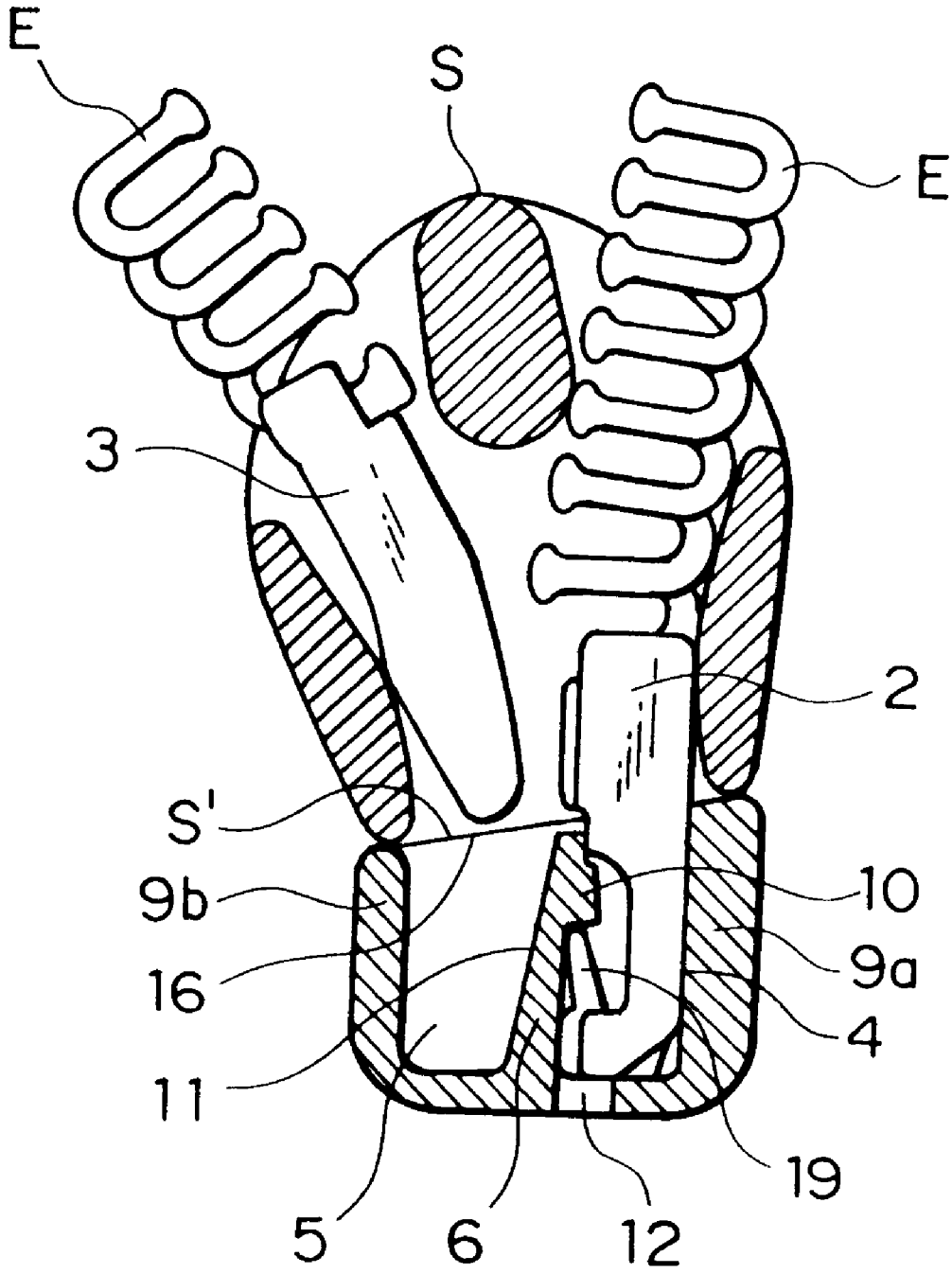
FIG. 10 is an operational view showing an operation of the separable bottom stop assembly and a state in which the insert pin is being inserted into the box member.
Figure 11:
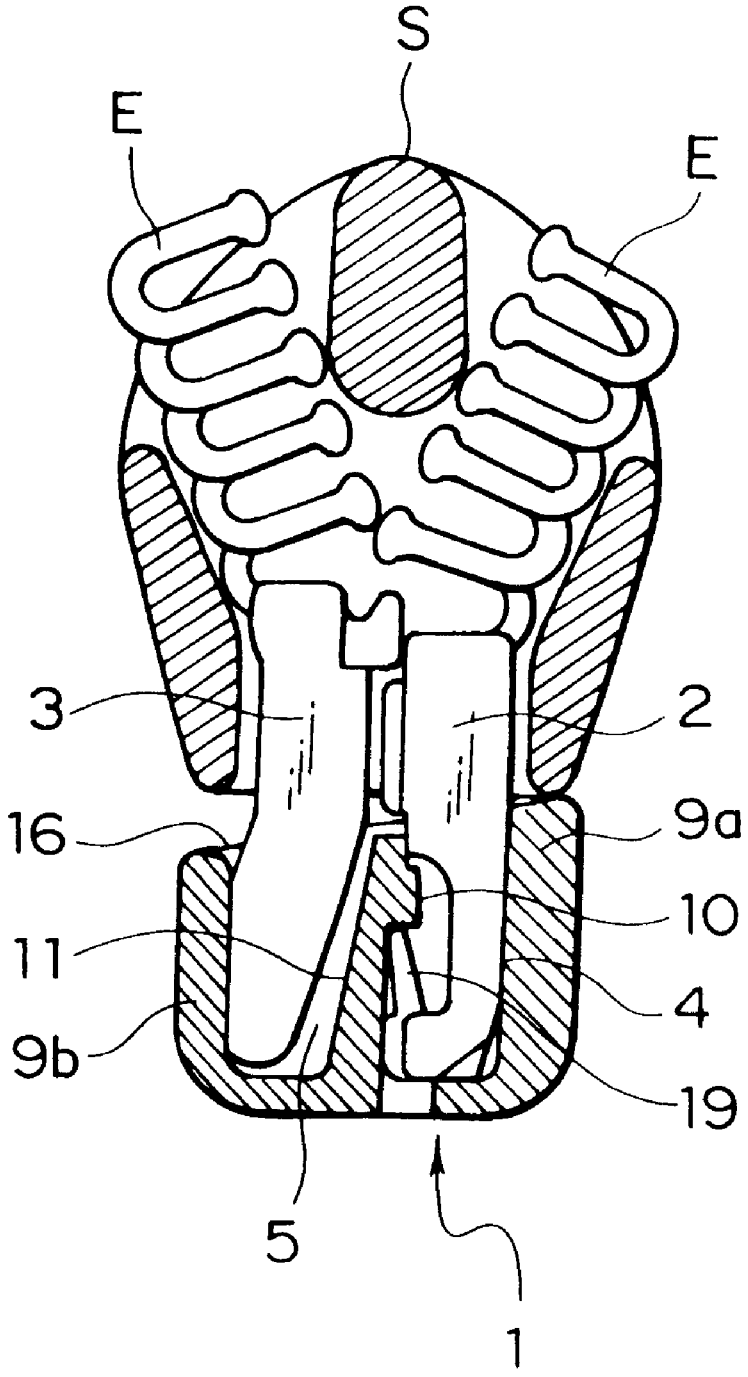
FIG. 11 is an operational view showing an operation of the same separable bottom stop assembly and a state in which the insert pin has been inserted into the box member.

For engaging or releasing operation, as schematically shown in FIG. 9, the slider S is attached to the fastener stringer T to which the box pin 1 is attached and as shown in FIG. 10, the slider S is brought into contact with the slope face portion 16 of the box member 1. With the slider S disposed in an inclined posture, the insert pin 3 attached to the other fastener stringer T is inserted into the slider S. The insert pin 3 is inserted into the insert-pin-insertion hole 5 as being guided by the guide portion 11 of the box member 1. After that, the position of the slider S is corrected as shown in FIG. 11. Then, by pulling the slider S in its closing direction, the right and left fastener elements E are engaged with each other so as to close the concealed type fastener stringer. When it is intended to open and separate the closed fastener stringers T, T, the slider S is pulled down so as to bring the slider S into contact with the slope face portion 16 of the box member 1. Then, the insert pin 3 is pulled out from the inclined slider S, whereby the right and left fastener stringers T, T can be separated from each other.

Figure 13:
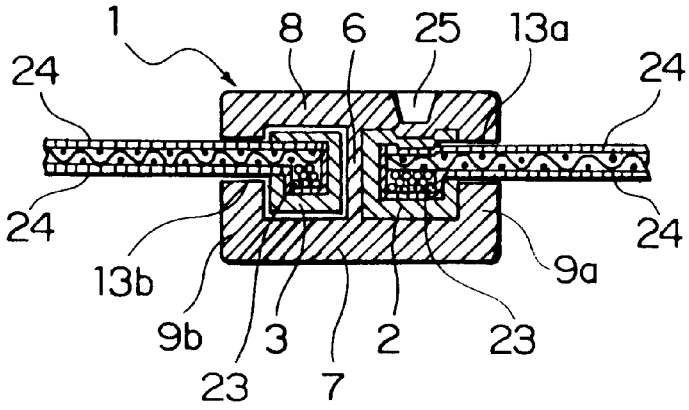
FIG. 13 is a sectional view of the same separable bottom stop assembly taken along the line C—C of FIG. 12.

A separable bottom stop assembly of ordinary type slide fastener according to a second embodiment will be described with reference to FIGS. 12 and 13. The separable bottom stop assembly is comprised of three members, i.e., a box member 1, a box pin 2 and an insert pin 3, which are molded integrally by die casting using aluminum alloy and zinc alloy. Each of the box pin 2 and insert pin 3 has a substantially rectangular cross sectional shape and mounted on a side edge of a stringer tape T by crimping such that they are joined to fastener elements E mounted on the side edge of the stringer tape T. The box member 1 contains a box-pin-insertion hole 4 and an insert-pin-insertion hole 5 at the right and left sides thereof. The box member 1 is fitted onto the box pin 2 mounted on one stringer tape T, so that the separable bottom stop assembly is completed.

As shown in FIG. 12, the coil-like fastener elements E formed of monofilament of thermoplastic synthetic resin fiber with a core thread 23 inserted therein is sewed to a surface of the side edge of one flat stringer tape T so that the coupling head portions H of the fastener elements E are protruded from the side edge of the stringer tape T. Then, as shown in FIG. 13, the core thread 23 Without the fastener elements E at an end of the stringer tape T is attached to the surface coated with a reinforcement tape 24 such as thermoplastic resin film and the substantially rectangular cross sectional box pin 2 is continuously joined to the fastener elements E. Further, the insert pin 3 is also mounted to the side edge of the other stringer tape T in the same manner as the box pin 2.

The box member 1 is a rectangular solid shape and has a partition 6 in a center of the box member 1 to form a box-pin-insertion hole 4 and an insert-pin-insertion hole 5. A face of the partition 6 facing the insert-pin-insertion hole 5 is inclined through its entire length so as to provide the guide portion 11 for guiding the insert pin 3 to be inserted. Further, a face of the partition facing the box-pin-insertion hole 4 is vertical so that both the box-pin-insertion hole 4 and the insert-pin-insertion hole 5 have bottoms.

Guide grooves 13*a* and 13*b* in which the stringer tapes T can be inserted are formed in side walls 9*a* and 9*b* at both sides of the box member 1 so as to extend to the bottoms of the box-pin-insertion hole 4 and insert-pin-insertion hole 5. Further, a slope face portion 16 having a downward gradient is formed on a top surface of the box member 1 from the side wall 9*a* of the box-pin-insertion hole 4 up to the side wall 9*b* of the insert-pin-insertion hole 5. The slope face portion 16 comes into contact with a rear end portion S' of the slider S so that the slider S can be placed in an inclined state. The partition 6 of the box member 1 is extended up to the slope face portion 16.

For assembling the box member 1 with the box pin 2, the box pin 2 is firstly inserted into the box-pin-insertion hole 4 of the box member 1 and at the same time, the stringer tape T is inserted into the guide groove 13*a* provided in the side wall 9*a* of the box member 1. After that, by forming a notch 25 in the rear wall 8 at the side of the box-pin-insertion hole 4 of the box member 1 as shown in FIG. 13, the box member 1 is fixed to the box pin 2.

For engaging or releasing operation, the slider S is attached to the fastener stringer T to which the box pin 2 is attached, and the slider S is brought into contact with the slope face portion 16 of the box member 1. With the slider S disposed in an inclined posture, the insert pin 3 attached to the other fastener stringer is inserted into the slider S. The insert pin 3 is inserted into the insert-pin-insertion hole 5 as being guided by the guide portion 11 of the box member 1. After that, the position of the slider S is corrected to a horizontal state. Then, by pulling the slider S in its closing direction, the right and left fastener stringers T, T are closed. When it is intended to open and separate the closed fastener stringers T, T, the slider S is pulled down so as to bring the slider S into contact with the slope face portion 16 of the box member 1. Then, the insert pin 3 is pulled out of the inclined slider S, whereby the right and left fastener stringers T, T can be separated from each other.

Although the embodiments of the present invention has been described about the coil-like fastener elements formed of monofilament of thermoplastic resin fiber, the fastener elements for use may be instead zigzag fastener elements, or separate fastener elements of thermoplastic resin or separate fastener elements of metal.

Figure 15:
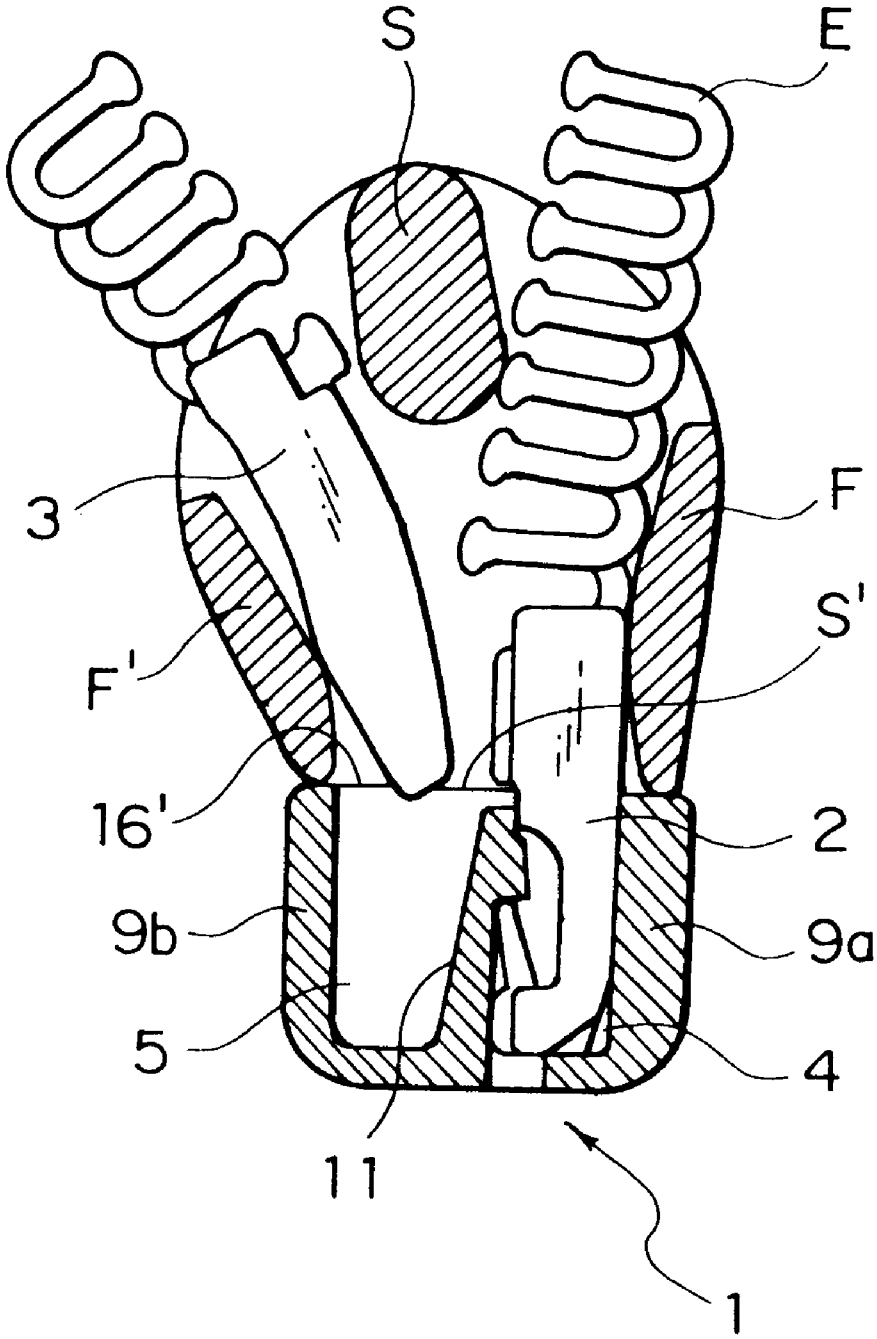
FIG. 15 is an operational view showing an operation of the same separable bottom stop assembly and a state in which the insert pin is being inserted into the box member.
Figure 16:
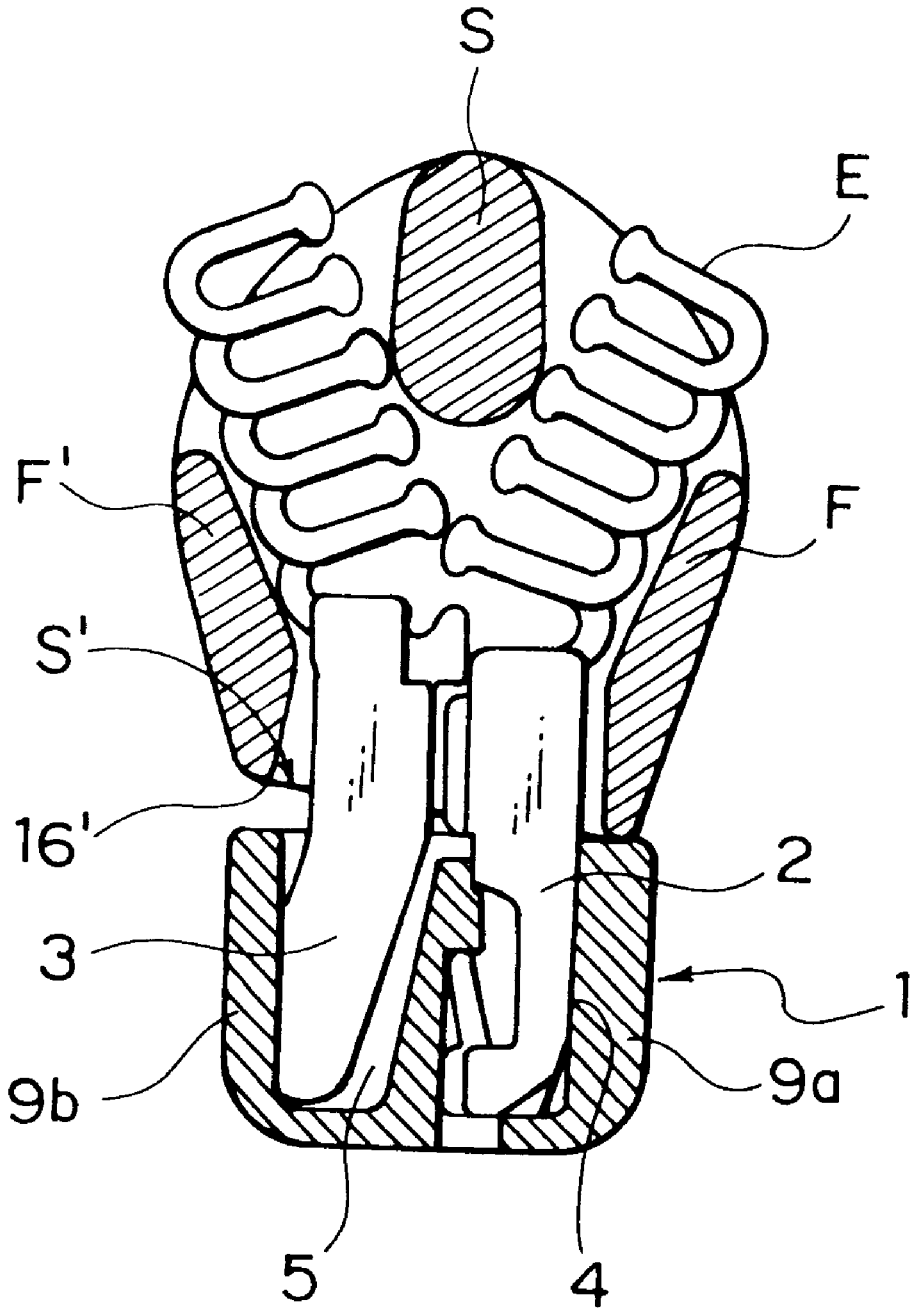
FIG. 16 is an operational view showing an operation of the same separable bottom stop assembly and a state in which the insert pin has been inserted into the box member.
Figure 17:
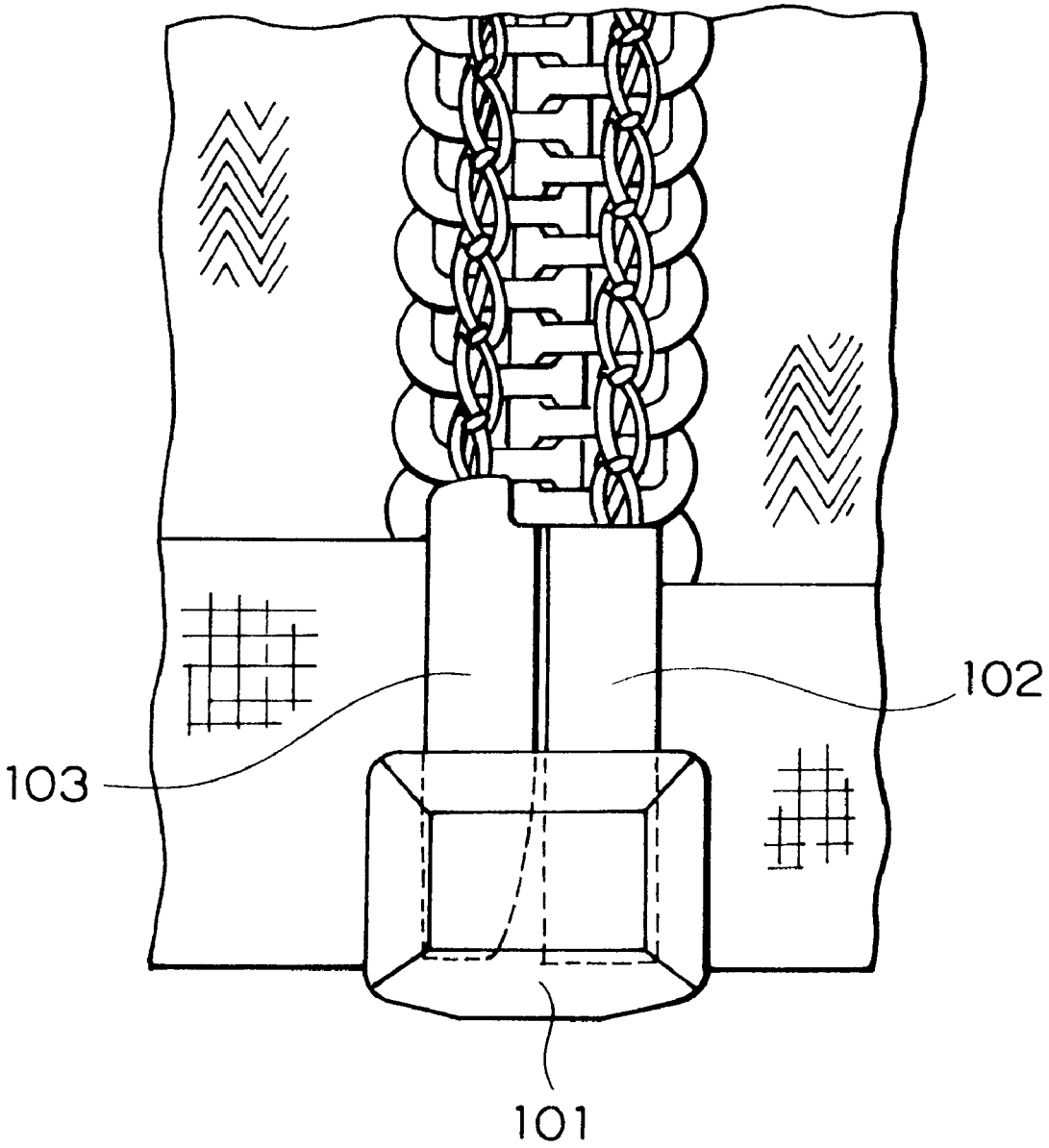
FIG. 17 PRIOR ART
FIG. 17 is a front view of a major portion of a fastener chain having a known ordinary type separable bottom stop assembly.
Figure 18:
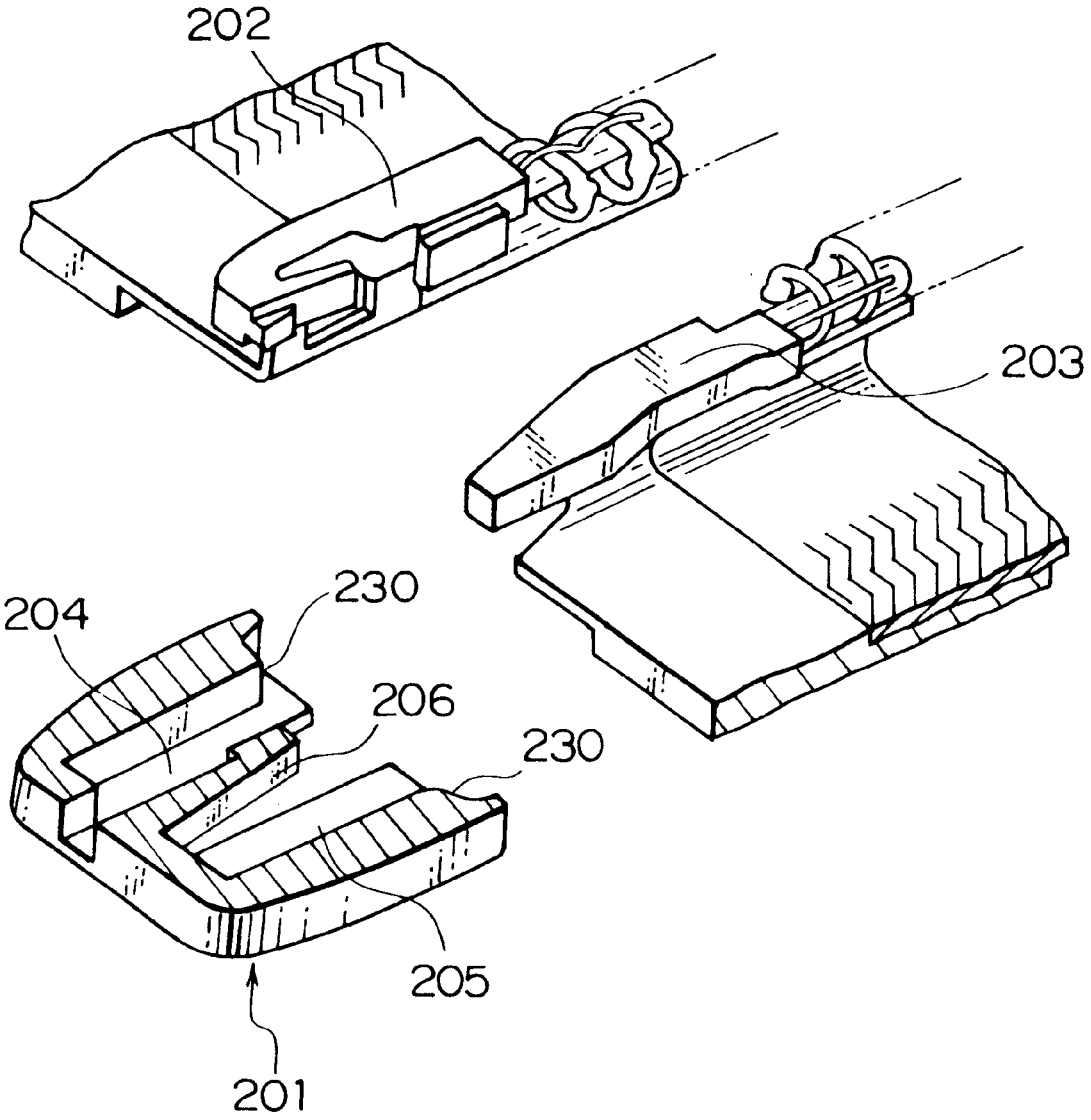
FIG. 18 is an exploded perspective view of a known concealed type separable bottom stop assembly.

Finally, a slider of the concealed type slide fastener with the separable bottom stop assembly according to a third embodiment will be described with reference to FIGS. 14 to 16. A box member 1 of the separable bottom stop assembly here is an ordinary type. A top face of the box member 1 is level and the box member 1 includes a box-pin-insertion hole 4 and an insert-pin-insertion hole 5 at right and left sides thereof. The configurations of the box member 1, box pin 2 and insert pin 3 are substantially the same as the separable bottom stop assembly of the first embodiment.

The slider S has an inclined slope face portion 16' at its rear end portion S'. The slider S is formed asymmetrically so as to provide a rising gradient from a flange F on a side which opposes and contacts a side wall 9*a* of the box-pin-insertion hole 4 of the box member 1 up to a flange F' on a side which opposes and contacts a side wall 9*b* of the insert-pin-insertion hole 5. Specifically, when the flange F is brought into contact with a side wall 9*a* of the box-pin-insertion hole 4, the slider S is capable of being inclined toward a side of the insert-pin-insertion hole 5 of the box member 1.

Figure 14:
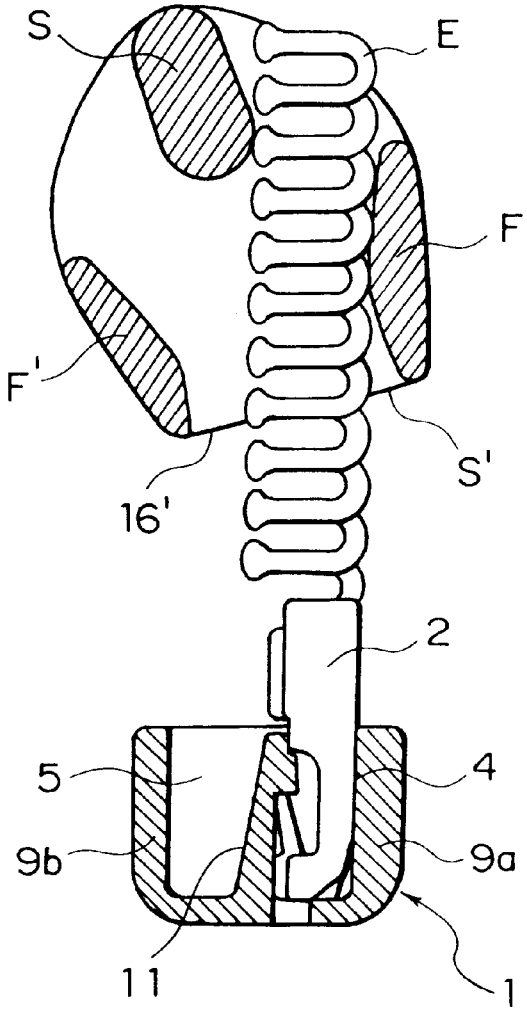
FIG. 14 is an operational view showing an operation of a concealed type separable bottom stop assembly according to a third embodiment and a state in which the slider is inserted through the fastener stringer.

As shown in FIG. 14, the slider S formed in the above manner is attached to a fastener stringer to which the box pin 2 is attached. As shown in FIG. 15, the slope face portion 16' of the rear end portion S' of the slider S is brought into contact with the top surface of the box member 1. With the slider S disposed in an inclined state, the insert pin 3 attached to the other fastener stringer is inserted into the slider S and then, the insert pin 3 is inserted into the insert-pin-insertion hole 5 as being guided by the guide portion 11 of the box member 1. After that, the position of the slider S is corrected as shown in FIG. 16. By pulling the slider S in its closing direction, the right and left fastener elements E are coupled with each other so as to close the concealed type fastener stringers. When it is intended to separate and open the closed fastener stringers, the slider S is pulled down and brought into contact with the box member 1. Then, by pulling the insert pin 3 out of the box member 1 and slider S, the right and left fastener stringers can be separated from each other.

When the insert pin 3 is inserted into the insert-pin-insertion hole 5 of the box member 1, because a side through which the insert pin 3 is to be inserted is inclined relative to the box member 1, the insert pin 3 is inserted obliquely from above like the slide fastener with the separable bottom stop assembly of the first embodiment, instead of being inserted from just above. As a result, the insert pin 3 can be inserted very smoothly.

The slide fastener with the separable bottom stop assembly has a structure described above. With such a structure, the present invention exerts the following effects.

According to the first aspect of the invention, a partition 6 is provided in a center of a box member 1 for partitioning the box member 1 to form a box-pin-insertion hole 4 and an insert-pin-insertion hole 5; a box pin 2 is inserted and fixed in the box-pin-insertion hole 4; an insert pin 3 is engagable with/disengagable from the insert-pin-insertion hole 5; and when a slider S is brought into contact with the box member 1, the slider S is adapted to make contact with the box member 1 such that it is inclined toward a side of the insert-pin-insertion hole 5 of the box member 1. Thus, the slider S can be disposed in an inclined posture with respect to the box member 1. As a result, the insertion of the insert pin 3 can be carried out very smoothly and a sewing work can be carried out easily by reducing a size of the box member 1, thereby contributing to saving of resources.

Further, according to the second aspect of the invention, an inclined slope face portion 16 is formed on a top face of the box member 1 such that said slope face portion 16 has a downward gradient from a side wall 9*a* of the box-pin-insertion hole 4 to a side wall 9*b* of the insert-pin-insertion hole 5. Thus, because the slider S is disposed in an inclined state relative to the box member 1 when it is brought into contact therewith, the insert pin 3 can be inserted into the box member 1 smoothly and easily.

Furthermore, according to the third aspect of the invention, the slider S has an inclined slope face portion 16' at a rear end portion S' thereof, such that said slope face portion 16' has a rising gradient from a flange F on a side thereof that can make contact with a side wall 9*a* of the box-pin-insertion hole 4 up to a flange F' on a side thereof that can make contact with a side wall 9*b* of the insert-pin-insertion hole 5. Thus, because the slider S is disposed in an inclined state relative to the box member 1 when it is brought into contact therewith, the insert pin 3 can be inserted into the box member 1 smoothly and easily.

Still further, according to the fourth aspect of the present invention, guide grooves 13*a*, 13*b* are provided on both sides of the partition 6 in a front wall 7 of the box member 1 so that stringer tapes T can be inserted therein. Thus, this separable bottom stop assembly can be applied to a concealed type slide fastener easily, so that practical use thereof can be achieved easily.

Still further, according to the fifth aspect of the present invention, guide grooves 13*a*, 13*b* are provided on both side walls 9*a*, 9*b* of the box member 1 so that stringer tapes T, T can be inserted therein. Therefore, this separable bottom stop assembly can be applied to an ordinary type slide fastener easily and practical use thereof can be achieved easily.

Still further, according to the sixth aspect of the present invention, the partition 6 has a guide portion 11 inclined along an entire length of the partition 6 on a side of the insert-pin-insertion hole 5; a protruded engaging portion 10 is provided on a top end of the partition 6 on a side of the box-pin-insertion hole 4; a tongue-like engaging piece 19 directed upward is provided on a bottom end of a front face of the box pin 2, wherein the engaging portion 10 of the partition 6 engages the engaging piece 19 of the box pin 2 when the box pin 2 is inserted into the box-pin-insertion hole 4. Therefore, the inserting operation of the insert pin 3 is easy, and the box pin 2 can be reliably fixed to the box member 1 without any pivotal movement.

Still further, according to the seventh aspect of the present invention, the box member 1 has a shallow guide groove 13*b* provided along the partition 6 in the front wall 7 of the insert-pin-insertion hole 5 and a deep guide groove 13*a* provided along the partition 6 in the front wall 7 of the box-pin-insertion hole 4. Therefore, since a depth of the guide groove 13*b* on a side of the insert-pin-insertion hole 5 can be made to a minimum, durability of the box member 1 is increased so that the box member 1 can hardly be broken.

Still further, according to the eighth and ninth aspects of the present invention, there is provided a slide fastener with separable bottom stop assembly in which the box pin 2 and the insert pin 3 are connected to supporting members 17, 17 fixed to the stringer tapes T, T by connecting portions 18, 18 that can be inserted into the guide grooves 13*a*, 13*b* respectively; the connecting portion 18 for the box pin 3 has a concave portion 20 or a through hole 21; the box member 1 has a protruded piece 14 protruding from substantially a center of a side face of the guide groove 13*a* toward an inside of the guide groove 13*a* formed in the front wall 7 of the box-pin-insertion hole 4, wherein the protruded piece 14 is adapted to be engaged with the connecting portion 18 below the concave portion 20 or the protruded piece 14 is adapted to be inserted through the through hole 21 and engaged with the connecting portion 18 below the through hole 21. Therefore, the box pin 2 can be reliably and firmly fixed to the box member 1 without any pivotal movement.

According to the tenth and eleventh aspects of the invention, the box member 1, box pin 2 and insert pin 3 are molded of thermoplastic resin by injection molding or extrusion molding, or molded of metal by die-casting respectively. Therefore, the concealed type and ordinary type separable bottom stop assembly can be easily molded of thermoplastic resin or metal. As described above, it is apparent that the present invention achieves remarkable advantages.

What is claimed is:

1. A slide fastener with separable bottom stop assembly, comprised of three members including a box member, a box pin and an insert pin, wherein a partition is provided in a box member for partitioning the box member to form a box-pin-insertion hole and an insert-pin-insertion hole; the box pin is inserted and fixed in the box-pin-insertion hole; the insert pin is engagable with/disengagable from the insert-pin-insertion hole; and when a rear end portion of a slider is brought into contact with a side wall of the box-pin-insertion hole, the slider is capable of being inclined toward a side of the insert-pin-insertion hole of the box member because an inclined slope face portion is formed on either the box member or the slider.

2. A slide fastener with separable bottom stop assembly according to claim 1, wherein an inclined slope face portion is formed on a top face of the box member such that said slope face portion has a downward gradient from a side wall of the box-pin-insertion hole to a side wall of the insert-pin-insertion hole.

3. A slide fastener with separable bottom stop assembly according to claim 1, wherein the slider has an inclined slope face portion at a rear end portion thereof, such that said slope face portion has a rising gradient from a flange on a side thereof that can make contact with a side wall of the box-pin-insertion hole up to a flange on a side thereof that can make contact with a side wall of the insert-pin-insertion hole.

4. A slide fastener with separable bottom stop assembly according to claim 1, wherein guide grooves are provided on both side walls of the box member so that stringer tapes can be inserted therein.

5. A slide fastener with separable bottom stop assembly according to claim 1, wherein the box member, box pin and insert pin are molded of thermoplastic resin by injection molding or extrusion.

6. A separable bottom stop assembly of slide fastener with separable bottom stop assembly according to claim 1, wherein the box member, box pin and insert pin are molded of metal by die-casting.

7. A slide fastener with separable bottom stop assembly according to claim 1, wherein guide grooves are provided on both sides of the partition in a front wall of the box member so that stringer tapes can be inserted therein.

8. A slide fastener with separable bottom stop assembly according to claim 7, wherein the partition has a guide portion inclined along an entire length of the partition on a side of the insert-pin-insertion hole; a protruded engaging portion is provided on a top end of the partition on a side of the box-pin-insertion hole; a tongue-like engaging piece directed upward is provided on a bottom end of a front face of the box pin; and the engaging portion of the partition engages the engaging piece of the box pin when the box pin is inserted into the box-pin-insertion hole.

9. A slide fastener with separable bottom stop assembly according to claim 7, wherein the box member has a shallow guide groove provided along the partition in the front wall of the insert-pin-insertion hole and a deep guide groove provided along the partition in the front wall of the box-pin-insertion hole.

10. A slide fastener with separable bottom stop assembly according to claim 7, wherein the box pin and the insert pin are connected to supporting members fixed to the stringer tapes by connecting portions that can be inserted into the guide grooves respectively; the connecting portion for the box pin has a concave portion; the box member has a protruded piece protruding from substantially a center of a side face of the guide groove toward an inside of the guide groove formed in the front wall of the box-pin-insertion hole; in which the protruded piece is adapted to be engaged with the connecting portion below the concave portion.

11. A slide fastener with separable bottom stop assembly according to claim 7, wherein the box pin and the insert pin are connected to supporting members fixed to the stringer tapes by connecting portions that can be inserted into the guide grooves respectively; the connecting portion for the box pin has a through hole; the box member has a protruded piece protruding from substantially a center of a side face of the guide groove toward an inside of the guide groove formed in the front wall of the box-pin-insertion hole; and the protruded piece is adapted to be inserted through the through hole and engaged with the connecting portion below the through hole.

* * * * *